US008882518B2

(12) United States Patent
Li

(10) Patent No.: US 8,882,518 B2
(45) Date of Patent: Nov. 11, 2014

(54) CONNECTOR PORT WITH PORT COVER AND ELECTRONIC DEVICE USING SAME

(71) Applicants: Fu Tai Hua Industry (Shenzhen) Co., Ltd., Shenzhen (CN); Hon Hai Precision Industry Co., Ltd., New Taipei (TW)

(72) Inventor: Guang-Chen Li, Shenzhen (CN)

(73) Assignees: Fu Tai Hua Industry (Shenzhen) Co., Ltd., Shenzhen (CN); Hon Hai Precision Industry Co., Ltd., New Taipei (TW)

( * ) Notice: Subject to any disclaimer, the term of this patent is extended or adjusted under 35 U.S.C. 154(b) by 22 days.

(21) Appl. No.: 13/727,593

(22) Filed: Dec. 27, 2012

(65) Prior Publication Data

US 2014/0154902 A1 Jun. 5, 2014

(30) Foreign Application Priority Data

Dec. 4, 2012 (CN) ..... 2012 1 0511281

(51) Int. Cl.
*H01R 13/44* (2006.01)
*H01R 13/453* (2006.01)

(52) U.S. Cl.
CPC ..... *H01R 13/4538* (2013.01)
USPC ..... 439/141

(58) Field of Classification Search
USPC ..... 439/140, 141, 135–137
See application file for complete search history.

(56) References Cited

U.S. PATENT DOCUMENTS

| | | | | |
|---|---|---|---|---|
| 6,062,881 | A * | 5/2000 | Ellison | 439/141 |
| 6,733,311 | B2 * | 5/2004 | Kameda | 439/140 |
| 7,150,636 | B2 * | 12/2006 | Zhu et al. | 439/141 |
| 7,766,677 | B2 * | 8/2010 | Chiang | 439/140 |

* cited by examiner

*Primary Examiner* — Felix O Figueroa
(74) *Attorney, Agent, or Firm* — Novak Druce Connolly Bove + Quigg LLP

(57) ABSTRACT

A connector port for mounting in a housing of an electronic device is illustrated. The connector port includes a shell defining an accessing hole having an opening, a port cover movably retained in the accessing hole, and a resilient element. The shell includes a plurality of spaced contact pins exposed in the accessing hole. One end of the resilient element is arranged adjacent to the port cover for maintaining the port cover at the opening of the accessing hole when the resilient element is in a natural state.

6 Claims, 9 Drawing Sheets

CONNECTOR PORT WITH PORT COVER AND ELECTRONIC DEVICE USING SAME

BACKGROUND

1. Technical Field

The disclosure relates electronic devices, and particularly to an electronic device having a connector port with a port cover.

2. Description of Related Art

Connector ports such as universal serial bus (USB) ports are often provided in electronic devices to transfer data between two different devices. A port cover is often used for preventing dust from entering the connector port when the connector port is not in use.

A conventional port cover is often a single piece that is detachable to the electronic device. Users must detach the port cover before using the connector port and attach the port cover to the electronic after using the connector port. Thus, it's a waste of time to detach and attach the port cover when using the connector port.

BRIEF DESCRIPTION OF THE DRAWINGS

Many aspects of the embodiments can be better understood with reference to the following drawings. The components in the drawings are not necessarily drawn to scale, the emphasis instead being placed upon clearly illustrating the principles of the present disclosure. Moreover, in the drawings, like reference numerals designate corresponding parts throughout the several views.

FIG. 9 is an isometric view of an electronic device and two plugs inserting into the connector ports of the electronic device a.

DETAILED DESCRIPTION

Embodiments of the present disclosure are now described in detail, with reference to the accompanying drawings.

Figure 1:
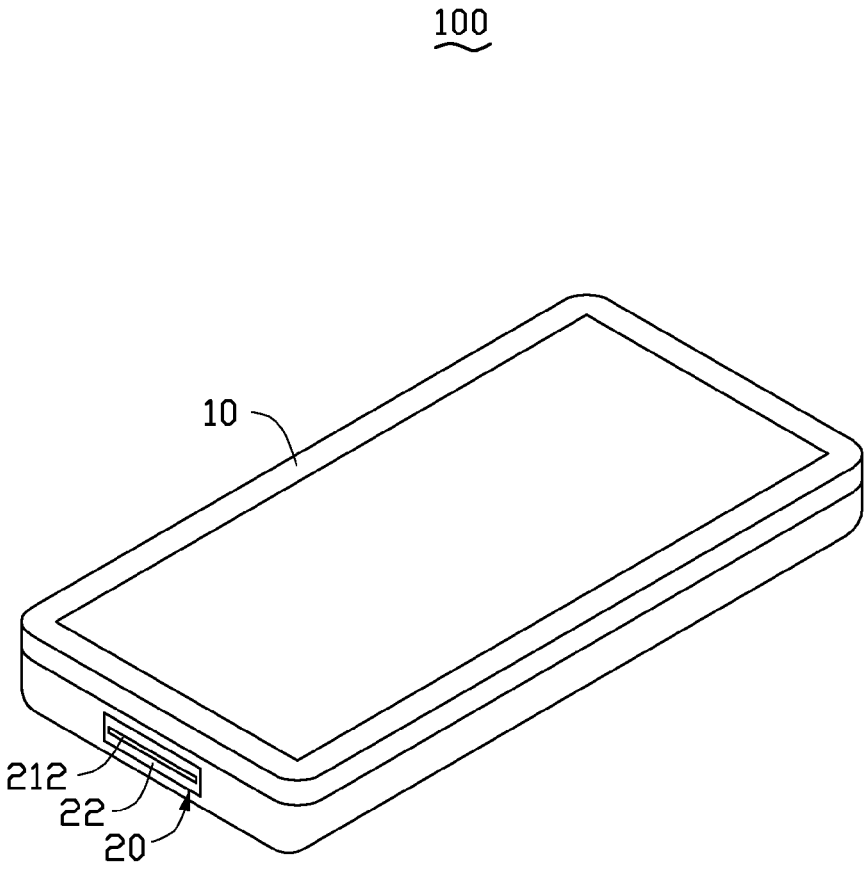
FIG. 1 is an isometric view of an electronic device having a connector port according to a first embodiment.

FIG. 1 shows an electronic device 100 according to a first embodiment of the disclosure. The electronic device 100 includes a rectangular housing 10 and a connector port 20 according to a first embodiment for mounting in the housing 10. In the embodiment, the port connector 20 is a universal serial bus (USB) port.

Figure 2:
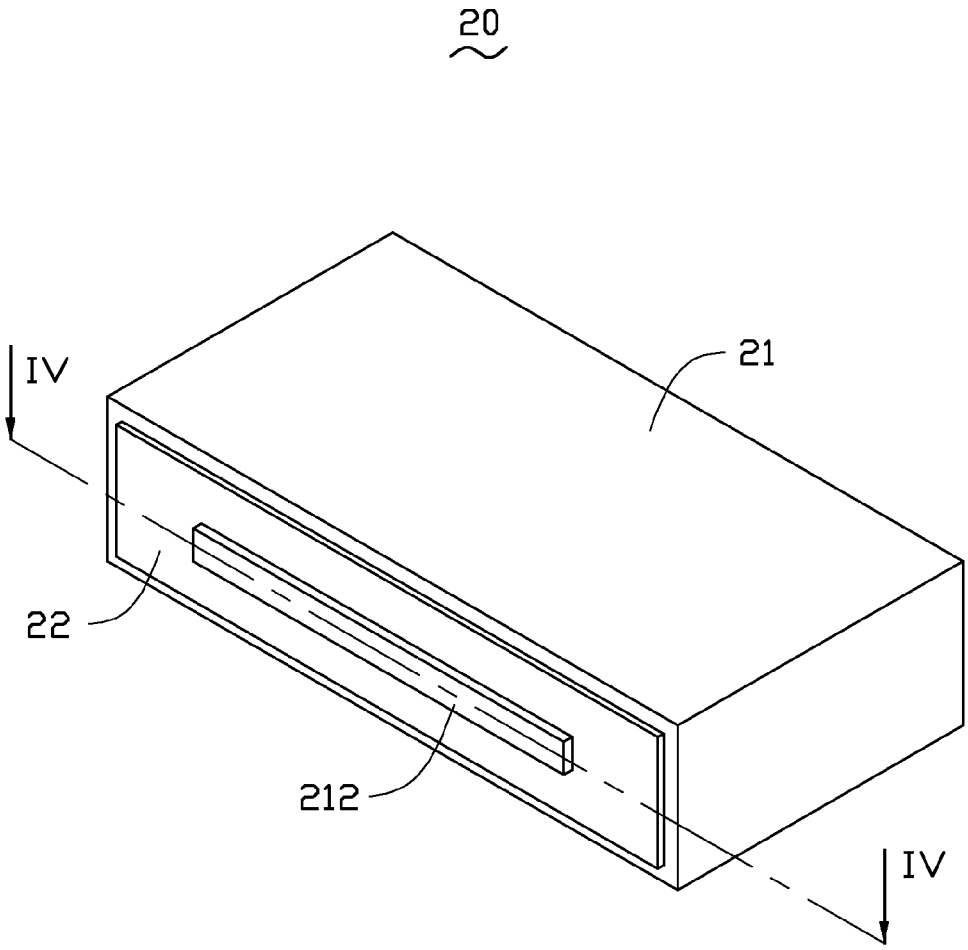
FIG. 2 is an isometric view of the connector port of the electronic device in FIG. 1.
Figure 3:
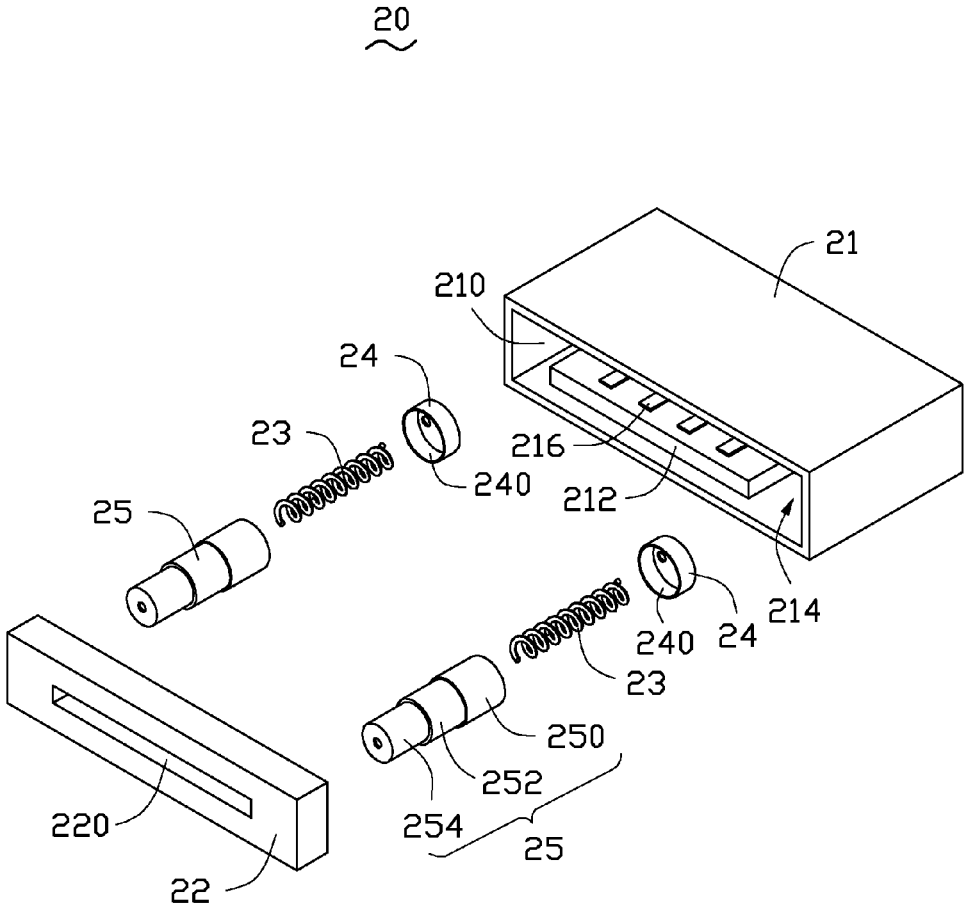
FIG. 3 is an exploded, isometric view of the connector port of FIG. 2.
Figure 4:
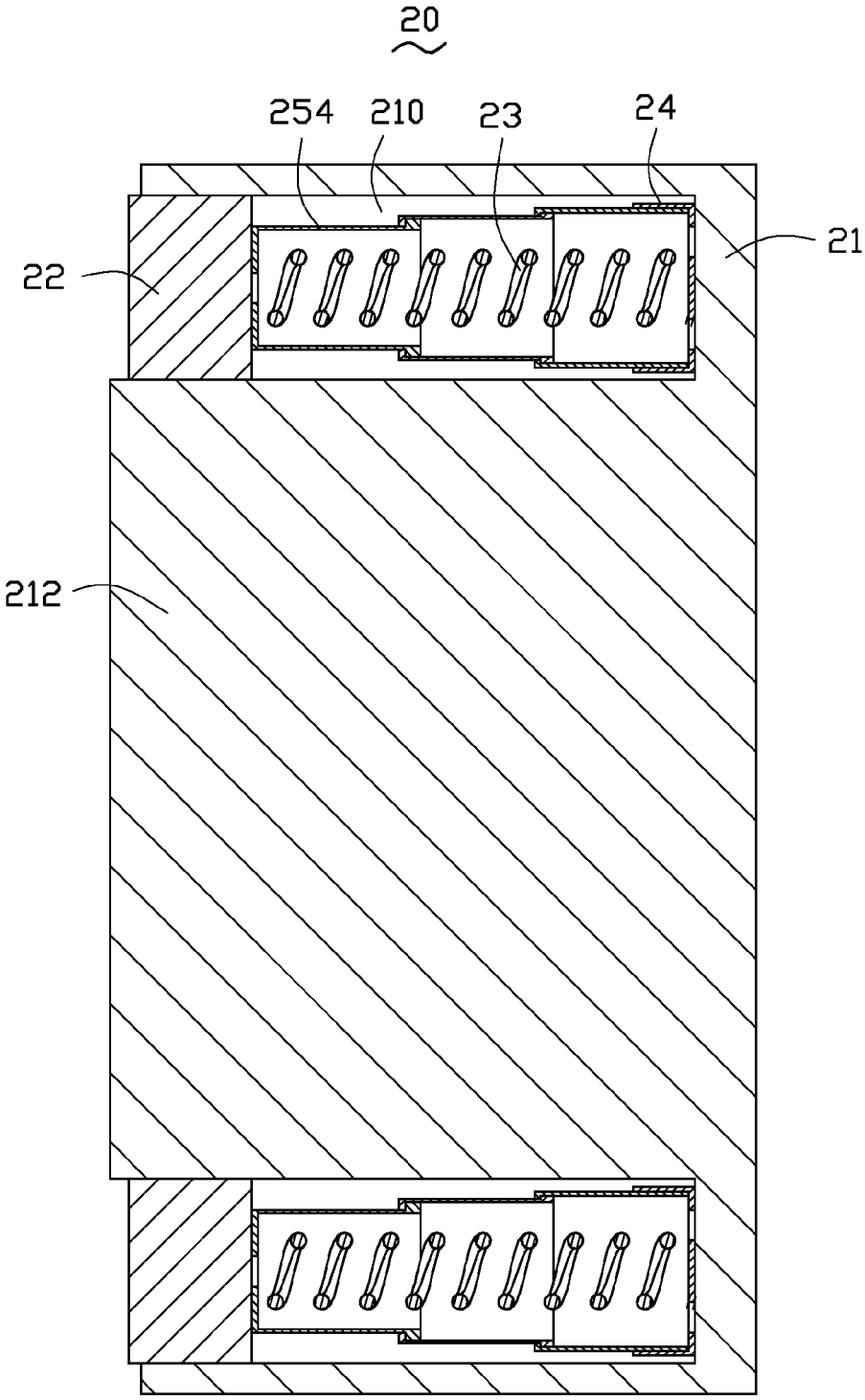
FIG. 4 is a cross-sectional view of the connector port, taken along line IV-IV of FIG. 2.

FIGS. 2-4 show that the port connector 20 includes a housing 21, a port cover 22, a resilient element 23, a fixing member 24, and a telescopic tube 25. The housing 21 defines an accessing hole 210 having an opening 214 and includes a connecting plate 212 protruding outwardly from a bottom of the accessing hole 210. A number of contact pins 216 are formed on the connecting plate 212 and spaced from each other. The port cover 22 is movably retained in the accessing hole 210 and defines a slot 220 through which the connecting plate 212 extends.

The telescopic tube 25 includes a first sleeve 250, a second sleeve 252, and a third sleeve 254 slidably received one into another. The fixing member 24 is fixed to a bottom of the accessing hole 210 and defines a fixing hole 240 for fixing the first sleeve 250. The resilient element 23 is received in the telescopic tube 25 for maintaining the telescopic tube 25 in an extended state.

Figure 5:
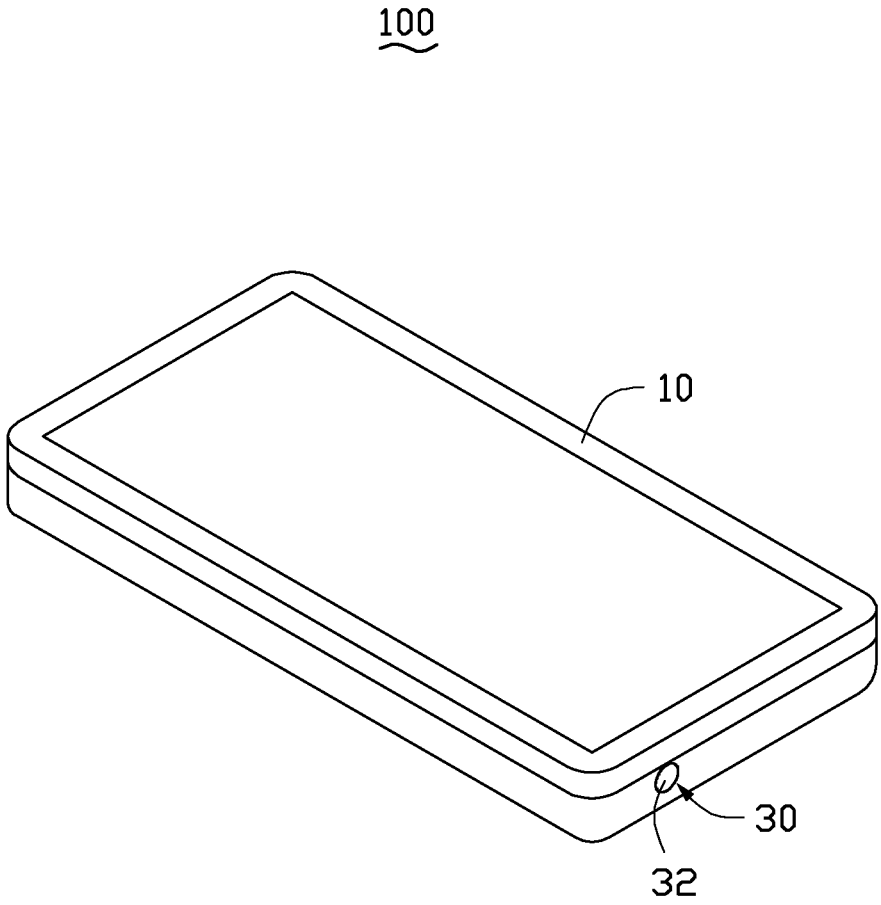
FIG. 5 is an isometric view of an electronic device having a connector port according to a second embodiment.

FIG. 5 shows that a connector port 30 according to a second embodiment assembled in the housing 10. In the embodiment, the connector port 30 is an audio input/output port.

Figure 6:
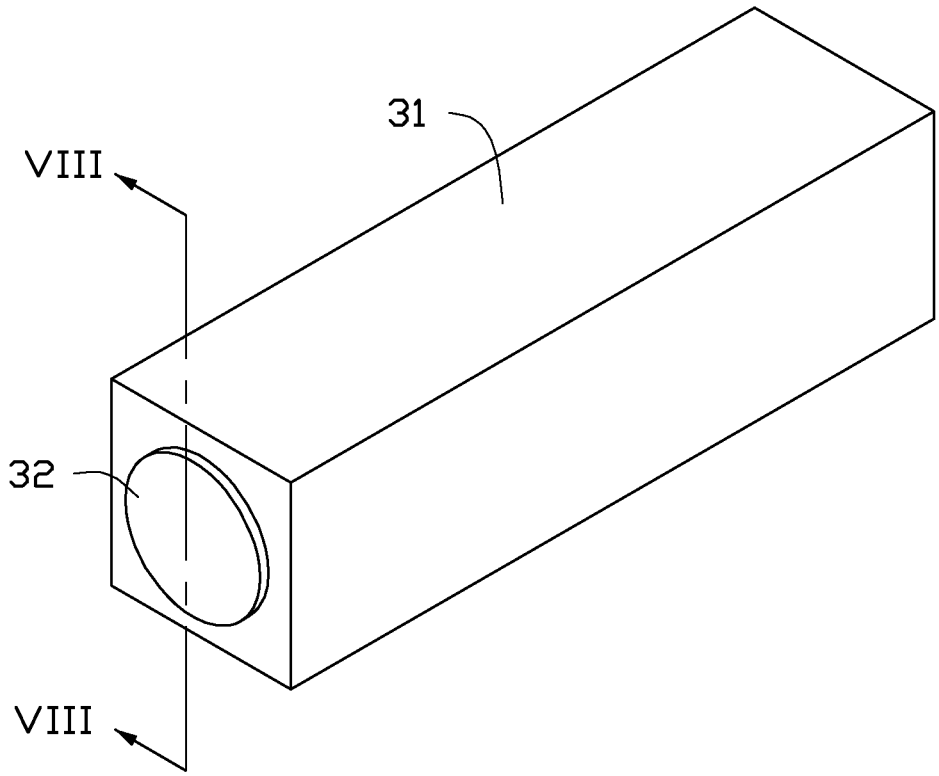
FIG. 6 is an isometric view of the connector port of the electronic device in FIG. 5.
Figure 7:
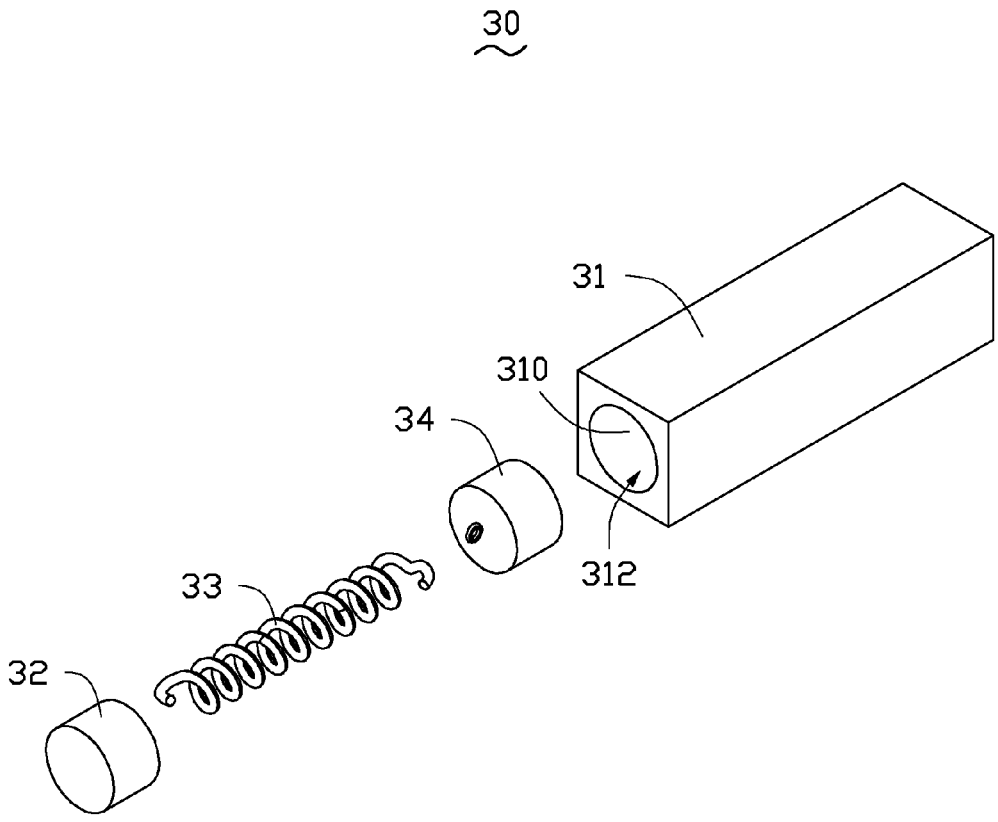
FIG. 7 is an exploded, isometric view of the connector port of FIG. 6.
Figure 8:
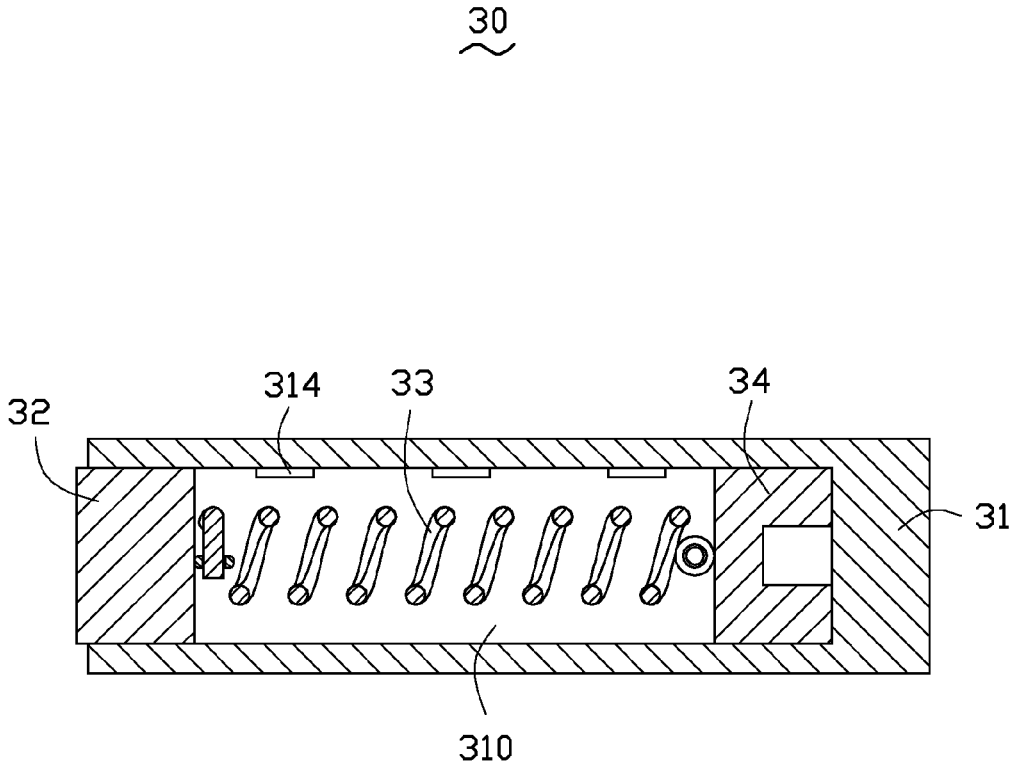
FIG. 8 is a cross-sectional view of the connector port, taken along line VIII-VIII of FIG. 6.

FIGS. 6-8 show that the connector port 30 includes a shell 31, a port cover 32, a resilient element 33, and a fixing member 34. The shell 31 defines an accessing hole 310 with an opening 312. A number of contact pins 314 are arranged common inner side surface of the shell 31 in the accessing hole 310 and spaced from each other. The port cover 32 is movably retained in the accessing hole 310. The fixing member 34 is fixed to a bottom of the accessing hole 310. One end of the resilient element 33 is fixed to the port cover 32, and another end is fixed to the fixing member 34.

When the connector ports 20, 30 are not in use, the resilient element 23 maintains the port cover 22 at the opening 214 of the accessing hole 210, and the resilient element 33 maintains the port cover 32 at the opening 312 of the accessing hole 31, thereby preventing dust from entering the connector ports 20, 30.

Figure 9:
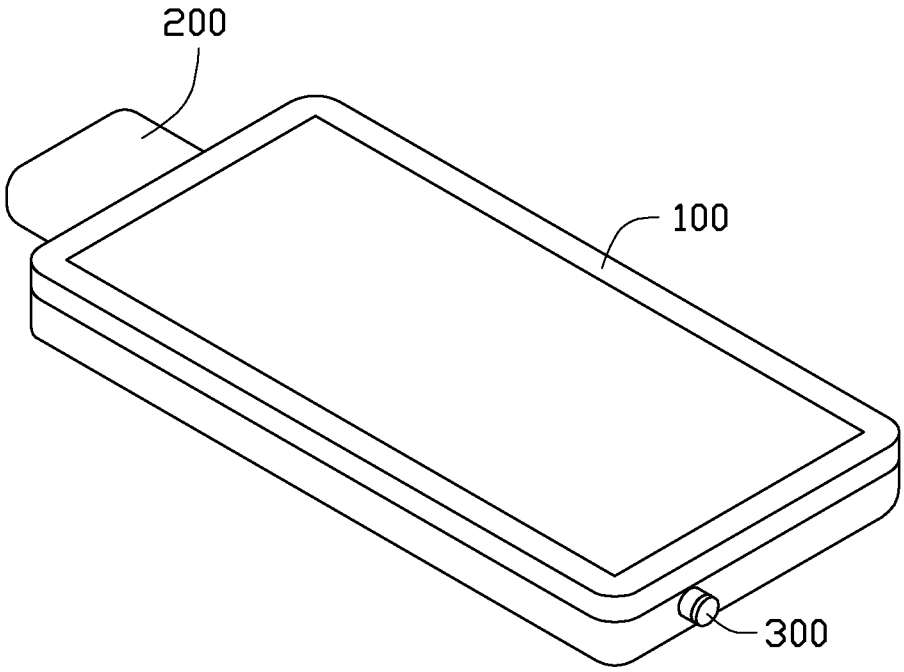

FIG. 9 shows that when using the connector ports 20, 30, two corresponding plugs 200, 300 can be directly inserted into the connector ports 20, 30 for electrically contacting the contact pins 216, 314 without detaching the port covers 22, 32.

While various embodiments have been described and illustrated, the disclosure is not to be constructed as being limited thereto. Various modifications can be made to the embodiments by those skilled in the art without departing from the true spirit and scope of the disclosure as defined by the appended claims.

What is claimed is:

1. A connector port for mounting in a housing of an electronic device, the connector port comprising:

a shell defining an accessing hole having an opening and comprising a plurality of spaced contact pins exposed in the accessing hole;

a port cover movably retained in the accessing hole;

a resilient element having one end arranged adjacent to the port cover for maintaining the port cover at the opening of the accessing hole when the resilient element is in a natural state;

a fixing member fixed to a bottom of the accessing hole, wherein another end of the resilient element is fixed to the fixing member; and a telescopic tube having a plurality of sleeves slidably received one into another, the fixing member fixing one distal end of the telescopic tube, the resilient element being received in the telescopic tube and configured for maintaining the telescopic tube in an extended state.

2. The port connector as described in claim 1, wherein the shell comprises a connecting plate protruding outwardly from a bottom of the accessing hole, the plurality of contact pins are formed on the connecting plate, and the port cover defines a slot through which the connecting plate extends.

3. The port connector as described in claim 1, wherein the plurality of contact pins are arranged on a common inner side surface of the shell in the accessing hole.

4. An electronic device comprising:

a housing; and a connector port comprising:

a shell defining an accessing hole having an opening and comprising a plurality of spaced contact pins in the accessing hole;

a port cover movably retained in the accessing hole;

a resilient element one end of which is fixed to the port cover for maintaining the port cover at the opening of the accessing hole;

a fixing member fixed to a bottom of the accessing hole, wherein another end of the resilient element is fixed to the fixing member; and a telescopic tube having a plurality of sleeves slidably received one into another, the fixing member fixing one distal end of the telescopic tube, the resilient element being received in the telescopic tube and configured for maintaining the telescopic tube in an extended state.

5. The electronic device as described in claim 4, wherein the shell comprises a connecting plate protruding outwardly from a bottom of the accessing hole, the plurality of contact pins are formed on the connecting plate, and the port cover defines a slot through which the connecting plate extends.

6. The electronic device as described in claim 4, wherein the plurality of contact pins are arranged on a common inner side surface of the shell in the accessing hole.

* * * * *